US006583564B1

(12) United States Patent
Kiryu et al.

(10) Patent No.: US 6,583,564 B1
(45) Date of Patent: Jun. 24, 2003

(54) DISCHARGE LAMP WITH LIGHT-INTERCEPTING FILM BANDS

(75) Inventors: Hideaki Kiryu, Osaka (JP); Takayuki Murase, Osaka (JP)

(73) Assignee: Matsushita Electric Industrial Co., Ltd., Kadoma (JP)

( * ) Notice: Subject to any disclaimer, the term of this patent is extended or adjusted under 35 U.S.C. 154(b) by 146 days.

(21) Appl. No.: 09/712,325

(22) Filed: Nov. 14, 2000

(30) Foreign Application Priority Data

Nov. 17, 1999 (JP) ..... 11-327360

(51) Int. Cl.[7] ..... H01J 17/16; H01J 61/30; H01J 61/35

(52) U.S. Cl. ..... 313/634; 313/635

(58) Field of Search ..... 313/635, 112, 313/25, 570, 573, 634

(56) References Cited

U.S. PATENT DOCUMENTS

| | | | | |
|---|---|---|---|---|
| 4,794,297 A | * | 12/1988 | Gaugel et al. | 313/117 |
| 5,578,893 A | * | 11/1996 | Yamamoto | 313/112 |
| 5,646,471 A | * | 7/1997 | Scholler et al. | 313/112 |
| 5,689,154 A | * | 11/1997 | Barthelmes et al. | 313/113 |
| 5,965,983 A | * | 10/1999 | Bouwkamp-Wijnoltz et al. | 313/635 |
| 6,287,163 B2 | | 9/2001 | Tanaka et al. | |
| 6,322,623 B1 | * | 11/2001 | Mifune et al. | 106/197.01 |
| 6,384,535 B1 | * | 5/2002 | Tanaka et al. | 313/112 |

FOREIGN PATENT DOCUMENTS

| | | |
|---|---|---|
| EP | 0935277 A1 | 8/1999 |
| JP | 9-500489 | 1/1997 |
| JP | 11-224650 | 8/1999 |

OTHER PUBLICATIONS

Mar. 2001 European Search Report, Mar. 2001.

* cited by examiner

*Primary Examiner*—Ashok Patel
*Assistant Examiner*—Glenn Zimmerman
(74) *Attorney, Agent, or Firm*—Merchant & Gould P.C.

(57) ABSTRACT

A discharge lamp which enables glare reduction, so that a lighting fixture can be simplified and reduced in weight. The discharge lamp includes an arc tube having a discharge space, a pair of electrodes having tips facing with each other within the discharge space, an outer tube enclosing the arc tube, a base that fixes one side of the outer tube, and two band-shaped light-intercepting films extending on a surface of the outer tube in the direction of the axis of the arc tube and in parallel with each other, wherein in at least one of the light-intercepting films, an extending portion is formed that extends on the side of the top of the outer tube with respect to the tip of the electrode within the discharge space and in the circumferential direction of the outer tube. Accordingly, unevenness in the intensity distribution of the light distribution pattern can be reduced, and generation of glare can be prevented. Furthermore, because it is not necessary to add a further mechanism for reducing glare such as a light-intercepting plate, a lighting fixture can be simplified and reduced in weight.

13 Claims, 11 Drawing Sheets

DISCHARGE LAMP WITH LIGHT-INTERCEPTING FILM BANDS

FIELD OF THE INVENTION

The present invention relates to a discharge lamp for a headlight, more particularly to the shapes of light-intercepting films included in a lamp.

BACKGROUND OF THE INVENTION

When a discharge lamp is used as a light source for a vehicle headlight or for a liquid crystal projector, it is combined with a reflecting mirror. In recent years, to prevent a reflecting mirror from being deteriorated by ultraviolet rays radiated from a discharge lamp, a discharge lamp including ultraviolet-cutting glass as an outer tube has been used widely.

In general, to realize a proper light distribution by combining a reflecting mirror and a discharge lamp, it is required to control the position of a luminous portion, namely, an arc, with respect to the reflecting mirror with extremely high precision.

However, because the light distribution of an arc, which is a luminous portion of a discharge lamp, is influenced by such factors as the shape of an arc tube, internal pressure, lamp voltage, tube current, etc., it is difficult to control it mechanically in the same way as a filament used in a bulb, etc. Thus, it has been proposed to obtain an accurate light distribution by intercepting optically a part of the arc, which is difficult to control for its position, by forming a light-intercepting film on an outer tube.

JP-9-500489A proposes a discharge lamp including an arc tube enclosed by an outer tube. In the discharge lamp, external lead wires extend from respective electrodes to respective contact points to a base. A neck portion of the arc tube is fixed into the base, and a power supply line for one external lead wire extends along the external surface of the outer tube.

On the outer tube, a light-intercepting film extends on the side close to the base, from the position making an angle $\alpha$ of 50 degrees with a line perpendicular to the outer tube at the center region between the electrodes, to the position making an angle $\beta$ of 65 degrees with the same line. Furthermore, on the outer tube, two band-shaped light-intercepting films extend in parallel with the outer tube, and the two band-shaped light-intercepting films face apart from each other. The two band-shaped light-intercepting films have respective edges making an angle $\gamma$ of 165 degrees with respect to the circumference of the outer tube, and respective edges facing with each other and making an angle $\delta$ of between 85 degrees and 145 degrees.

FIG. 11A illustrates a configuration of a headlight using the conventional discharge lamp. A discharge lamp 40 includes an arc tube 42 enclosed by an outer tube 41, and is arranged within a mirror 45 having a front glass 44 mounted at its opening. A light-intercepting film 46*a* extends on the side close to a base 43 of the outer tube 41, and two band-shaped light-intercepting films 46*b* (only a film on one side is shown) extend in parallel with the axial direction of the outer tube 41.

As shown by the arrows "a", light radiated from the arc tube 42 is reflected by the mirror 45, and passes through the front glass 44 to illuminate forward. FIG. 11B shows a light distribution pattern. A region 48 is a region illuminated by light passing through the front glass 44.

A region 50 indicated by a dot pattern shows a region where light passing through the front glass 44 does not reach. The boundary between the regions 48 and 50 is a cutline 49. To form such a light distribution pattern, unwanted light is cut from light radiated from,the arc tube 42 by the light-intercepting films 46*a* and 46*b* and sections 47*a*, 47*b* of a light-intercepting plate 47.

Viewing the light distribution pattern in the up-and-down direction, the illuminated region indicated by 48*a* in FIG. 11B is wider than the illuminated region indicated by 48*b*. When a discharge lamp forming such a light distribution pattern is used for a vehicle, both sides of driving lane and opposing lane can be illuminated. For example, in the case of left-hand traffic, because the region 48*b* on the side of opposing lane is cut for its upper illuminated region compared to the region 48*a* on the side of driving lane, blinding of oncoming vehicles can be prevented.

In such a conventional discharge lamp, although generation of glare resulting from unwanted light in the direction to pass through these light-intercepting films can be inhibited by the light-intercepting film 46*a* on the side close to the base 43 and the two band-shaped light-intercepting films 46*b*, it has not been able to avoid glare resulting from unwanted light passing through a portion where no light-intercepting film is formed, particularly a portion far from the base 43.

For example, unwanted light (arrows "b" and "c") radiated from the arc tube 42 and reflected by the end on the side far from the base 43 (particularly, at the corners of the end of the outer tube 41) is reflected by the mirror 45, and passes through the front glass 44 to illuminate forward. Such light is unwanted to form the light distribution pattern as shown in FIG. 11B, and it will illuminate the region 50 that does not need to be illuminated, or will illuminate the region 48 that has been illuminated by the necessary light indicated by the arrows "a" over again. Thus, unevenness is generated in the intensity distribution of the light distribution pattern, resulting in the generation of glare.

To prevent such generation of glare, it is necessary to intercept unwanted light trying to enter the front glass 44 by providing a light-intercepting plate separately. Thus, increased structural complexity and increased weight of a lighting fixture have not been able to be avoided.

The present invention solves the above-mentioned conventional problem. It is an object of the present invention to provide a discharge lamp further including a light-intercepting film extending in a portion far from the base, so that glare can be reduced, and a lighting fixture can be simplified and reduced in weight.

SUMMARY OF THE INVENTION

In order to accomplish the above object, the present invention provides a first discharge lamp including: an arc tube having a discharge space in which a pair of electrodes having tips facing with each other are arranged; an outer tube enclosing the arc tube; a base that fixes one side of the outer tube; and two band-shaped light-intercepting films extending on a surface of the outer tube in the direction of the axis of the arc tube and in parallel with each other, the two band-shaped light-intercepting films having at least a portion overlapping both ends of the discharge space when viewing the outer tube in the direction perpendicular to the axis of the arc tube, wherein:

when the tip within the discharge space of the electrode on the side of the top of the outer tube between the pair of the electrodes is determined as a basis position, in at least one of the two band-shaped light-intercepting films, an extending portion is formed that is on the side of the top of the outer tube with respect to the basis position and extends in the circumferential direction of the outer tube. According to such a discharge lamp, reflected light from the end of the outer tube on the side far from the base can be cut, and unwanted light can be cut more reliably. Thus, unevenness in the intensity distribution of the light distribution pattern can be reduced, and generation of glare can be prevented. Furthermore, because glare can be reduced by the lamp itself, it is not necessary to intercept unwanted light by providing a light-intercepting plate separately, and it is not necessary to add a further mechanism for reducing glare such as a light-intercepting plate, so that a lighting fixture can be simplified and reduced in weight.

It is preferable that a power supply line further is arranged so as to face the side face of the outer tube, and the extending portion is formed so as to extend toward the side opposite to the side on which the power supply line and the outer tube face each other.

It is preferable that when under the condition in which the outer tube is cut in a plane including the center point between the tips of the pair of the electrodes in the direction perpendicular to the axis of the arc tube, the angle, taken with respect to the side opposite the extending portion, between the two lines connecting the center point and respective edges of the two light-intercepting films in the direction of the axis of the arc tube on the side of the extending portion is determined as an angle $\gamma$, and under the condition in which the outer tube is cut in the direction perpendicular to the axis of the arc tube in a portion where the extending portion is formed, the angle, taken with respect to the side opposite the extending portion between the two lines connecting the point on the axis of the arc tube and respective edges of the two light-intercepting films in the direction of the axis of the arc tube on the side of the extending portion is determined as an angle $\epsilon$, the maximum value of the angle $\epsilon$ is at least $(\gamma+10)$ degrees.

It is preferable that respective edges on one side of the two band-shaped light-intercepting films are connected through the extending portion.

It is preferable that the light-intercepting films are formed by uniting a heat-resistant light-intercepting sheet material with the surface of the outer tube. According to such a discharge lamp, the precision of the location of the light-intercepting films can be enhanced.

It is preferable that the heat-resistant light-intercepting sheet material is a greensheet containing an inorganic material and an inorganic matrix component, and the greensheet is united with the surface of the outer tube by calcining the greensheet adhered on the surface of the outer tube.

Next, the present invention provides a second discharge lamp including: an arc tube having a discharge space in which a pair of electrodes having tips facing with each other are arranged; an outer tube enclosing the arc tube; a base that fixes one side of the outer tube; and first two band-shaped light-intercepting films extending on a surface of the outer tube in the direction of the axis of the arc tube and in parallel with each other, the first light-intercepting films having at least a portion overlapping both ends of the discharge space when viewing the outer tube in the direction perpendicular to the axis of the arc tube, further including a second light-intercepting film covering the outer tube in the circumferential direction, wherein when the tip within the discharge space of the electrode on the side of the top of the outer tube between the pair of the electrodes is determined as a basis position, both edges of the second light-intercepting film in the direction of the axis of the arc tube are located on the side of the top of the outer tube with respect to the basis position. According to such a discharge lamp, reflected light from the end of the outer tube on the side far from the base can be cut, and unwanted light can be cut more reliably. Thus, unevenness in the intensity distribution of the light distribution pattern can be reduced, and generation of glare can be prevented. Furthermore, because glare are can be reduced by the lamp itself, it is not necessary to intercept unwanted light by providing a light-intercepting plate separately, and it is not necessary to add a further mechanism for reducing glare such as a light-intercepting plate, so that a lighting fixture can be simplified and reduced in weight.

In the second discharge lamp, it is preferable that the angle made by the line passing through the center point between the tips of the pair of the electrodes and perpendicular to the axis of the arc tube and the line connecting the center point and the edge of the second light-intercepting film closer to the center point is at least 40 degrees.

In the second discharge lamp, it is preferable that the angle made by the line perpendicular to the axis of the arc tube and the line connecting the center point and the edge of the second light-intercepting film farther from the center point is at least 70 degrees.

It is preferable that the second light-intercepting film covers the outer tube in a ring form.

It is preferable that the edge of the second light-intercepting film farther from the center point between the tips of the pair of the electrodes is located at the top of the outer tube, and the second light-intercepting film covers the outer tube in the circumferential direction and covers the top of the outer tube. According to such a discharge lamp, light trying to pass through the top or the vicinity of the top of the outer tube can be cut. Thus, it is not necessary to set a cap for intercepting light at an end of the discharge lamp or to provide a light-intercepting plate separately in front of the discharge lamp so as to cut such light.

It is preferable that the light-intercepting films are formed by uniting a heat-resistant light-intercepting sheet material with the surface of the outer tube. According to such a discharge lamp, precision of the location of the light-intercepting films can be enhanced.

It is preferable that the heat-resistant light-intercepting sheet material is a greensheet containing an inorganic material and an inorganic matrix component, and the greensheet is united with the surface of the outer tube by calcining the greensheet adhered on the surface of the outer tube.

PREFERRED EMBODIMENTS OF THE INVENTION

In the following, referring to the accompanying drawings, embodiments of the present invention will be described.

First Embodiment

Figure 1:
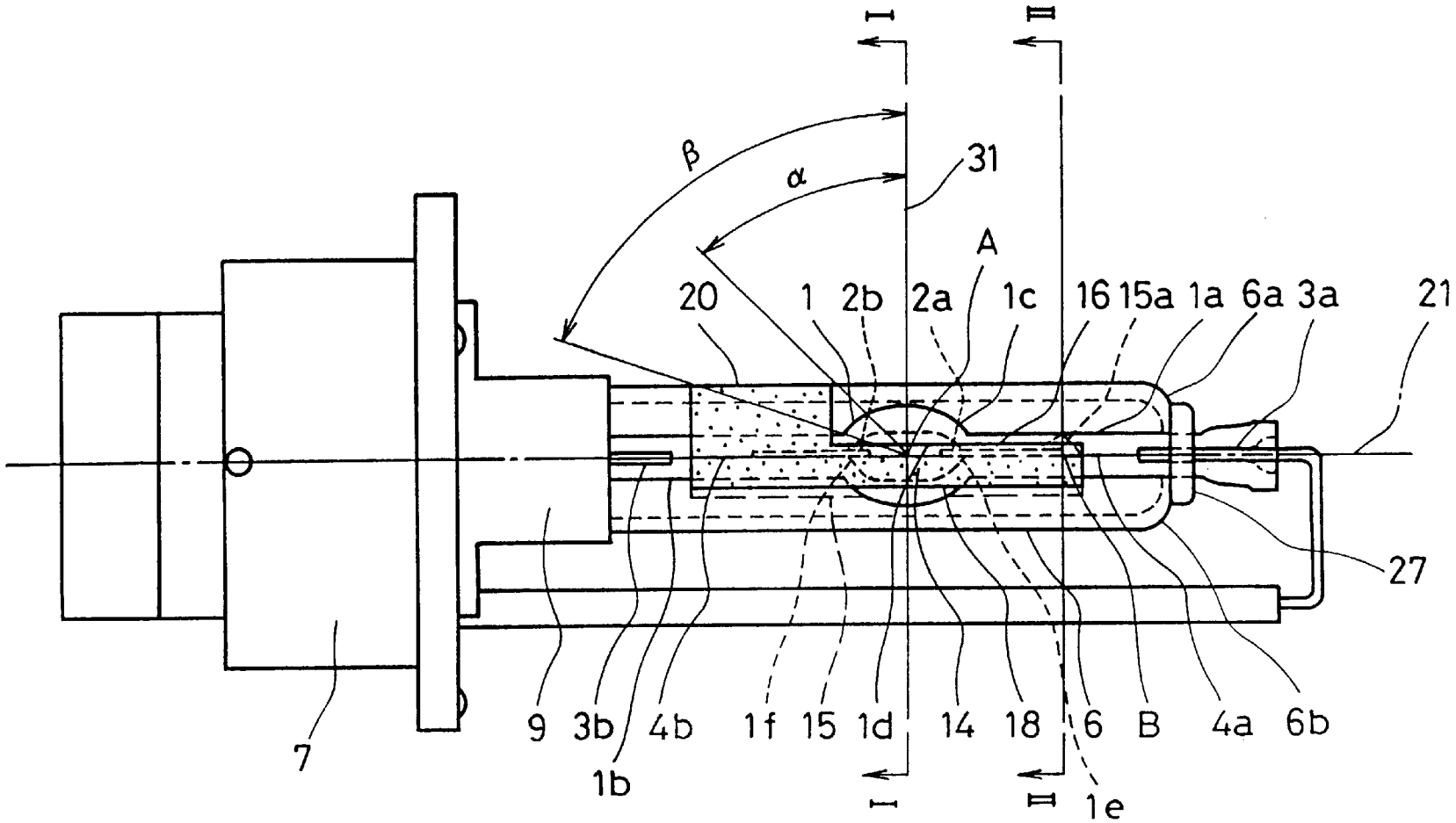
FIG. 1 is a side view of a metal halide lamp for a vehicle headlight according to a first embodiment of the present invention.
Figure 2:
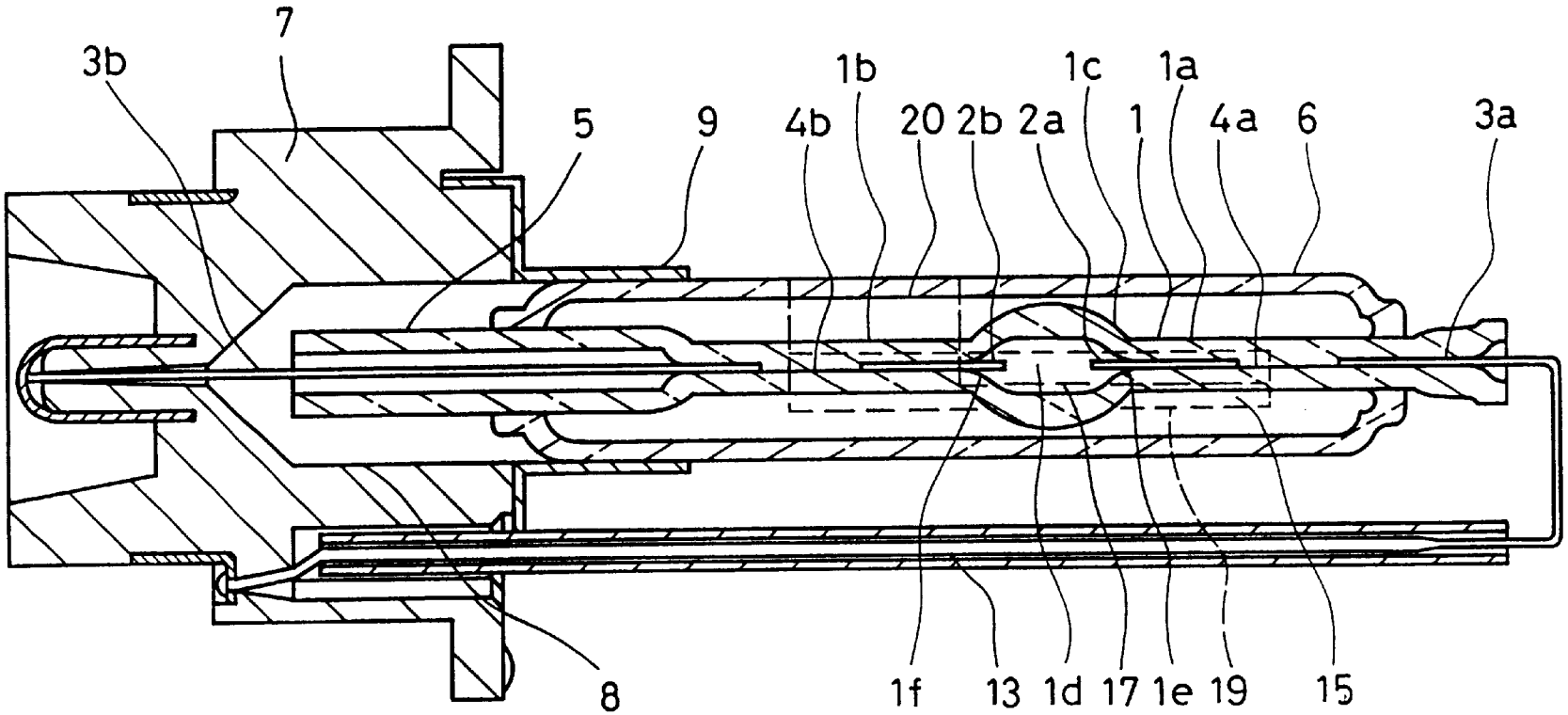
FIG. 2 is a sectional view of FIG. 1 cut in a plane including an axis in the longitudinal and vertical direction.

FIG. 1 is a side view of a discharge lamp according to the first embodiment of the present invention. The discharge lamp shown in this drawing is an embodiment of a metal halide lamp for a vehicle headlight. FIG. 2 is a sectional view of the discharge lamp illustrated in FIG. 1, which is cut in a plane including an axis 21 in the longitudinal direction.

As shown in FIGS. 1 and 2, the discharge lamp of this embodiment has an arc tube 1 within an outer tube 6, and the arc tube 1 includes a luminous portion 1*c* and a pair of compressed sealing portions 1*a* and 1*b* connected to both ends of the luminous portion 1*c*. A discharge space 1*d* is formed within the luminous portion 1*c*, and within the discharge space 1*d*, mercury, $ScI_3$ and NaI as metal halides, and xenon as a starting noble gas are enclosed. In FIG. 1, for easy understanding, main structures of the arc tube 1 within the transparent outer tube 6 are shown by solid lines (this is also the same for FIGS. 5 and 7), Both ends of the luminous portion 1*c* are sealed with the sealing portions 1*a* and 1*b* so that tips of electrodes 2*a* and 2*b* are located within the discharge space id. In the sealing portion la, one end of the electrode 2*a* and one end of an external lead wire 3*a* are connected with a metal foil 4*a*. Also, in the sealing portion 1*b*, one end of the electrode 2*b* and one end of an external lead wire 3*b* are connected with a metal foil 4*b*.

As illustrated in FIG. 2, the external lead wire 3*a* leading from the sealing portion 1*a* extends from a base 7 and is connected to a power supply line 13 arranged at a side of the outer tube 6. Furthermore, a tubular cylindrical portion 5 is connected to the sealing portion 1*b*, and the external lead wire 3*b* leads through inside the cylindrical portion 5.

Both ends of the outer tube 6 enclosing the arc tube 1 are sealed with the sealing portion 1*a* and the cylindrical portion 5, respectively. The cylindrical portion 5 of the arc tube 1 is inserted into a cavity 8 formed in a center region of the base 7. The base 7 is composed of a resin, such as polyetherimide, etc. A support 9 composed of a metal is attached to the base 7, and the outer tube 6 is fitted into the support 9 to be supported in the base 7.

Next, light-intercepting films formed on the outer tube 6 will be described. As shown in FIG. 1, two band-shaped light-intercepting films 14 and 15 are formed on the external surface of the outer tube 6. Under the condition as shown in FIG. 1, the light-intercepting film 14 is formed on the front side of the arc tube 1, and its outline is shown by a solid line. The light-intercepting film 15 is formed on the back side of the arc tube 1, and its outline is shown by a broken line.

To cut unwanted light from the discharge space id, the light-intercepting films 14 and 15 are formed so as to overlap the discharge space 1*d* when viewed from the direction perpendicular to the axis 21 of the arc tube 1, in other words, from the side of the side face of the outer tube 6. Specifically, under a condition as illustrated in FIG. 1, when viewing the light-intercepting films 14 and 15 in the direction perpendicular to the axis 21 of the arc tube 1, the light-intercepting films 14 and 15 include portions overlapping both ends 1*e* and 1*f* of the discharge space 1*d* in the direction of the axis 21. Furthermore, the light-intercepting films 14 and 15 are respectively parallel to the axis 21 of the arc tube and apart from each other.

The light-intercepting films 14 and 15 are formed by uniting a heatresistant light-intercepting sheet material with a surface of the outer tube 6, and patterning it in a predetermined shape. Accordingly, the precision of the location of the light-intercepting films can be enhanced.

Figure 5:
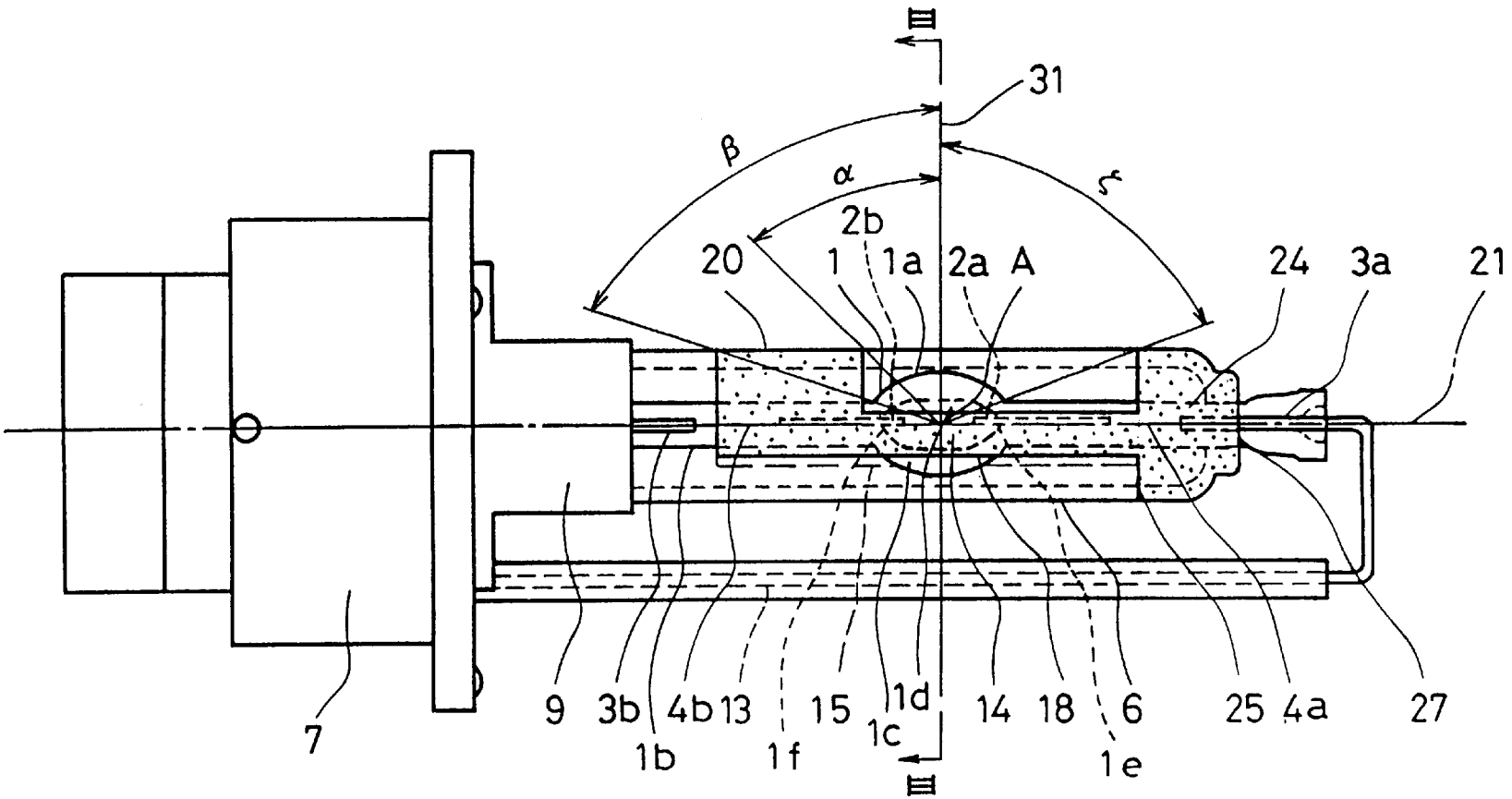
FIG. 5 is a side view of a metal halide lamp for a vehicle headlight according to a second embodiment of the present invention.
Figure 7:
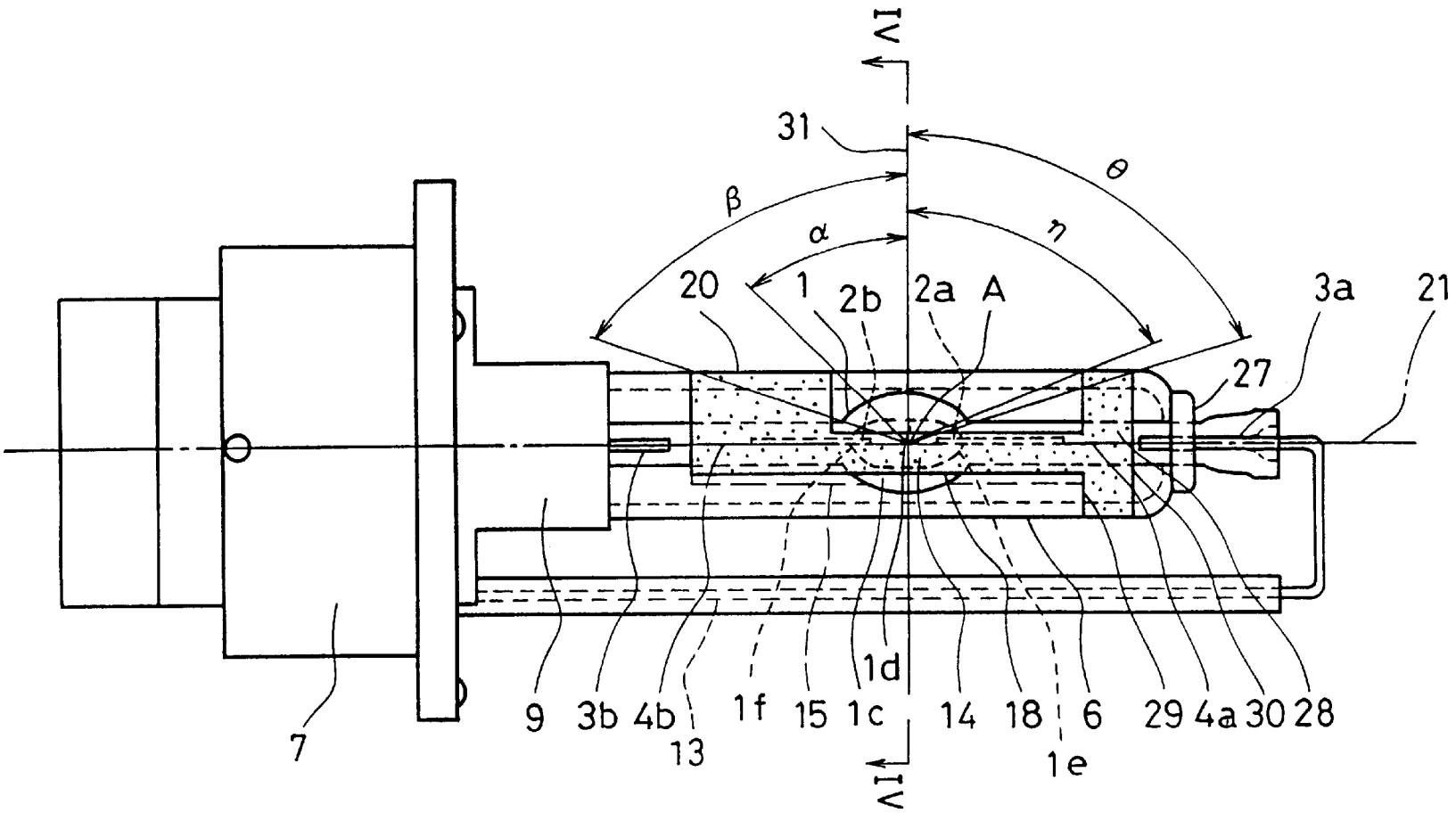
FIG. 7 is a side view of a metal halide lamp for a vehicle headlight according to a third embodiment of the present invention.

The arrangement and patterning of the light-intercepting films 14 and 15 described above are the same for the second and third embodiments illustrated in FIGS. 5 and 7.

As the heat-resistant light-intercepting sheet material, for example, a greensheet containing an inorganic material and an inorganic matrix component is used. The greensheet is a precursor material sheet, which is used when obtaining a sintered body using an inorganic material such as ceramics or glass as a matrix component. By adhering the greensheet to the outer tube 6 and calcining it, the light-intercepting films 14 and 15 can be formed and united with the surface of the outer tube 6.

Figure 3:
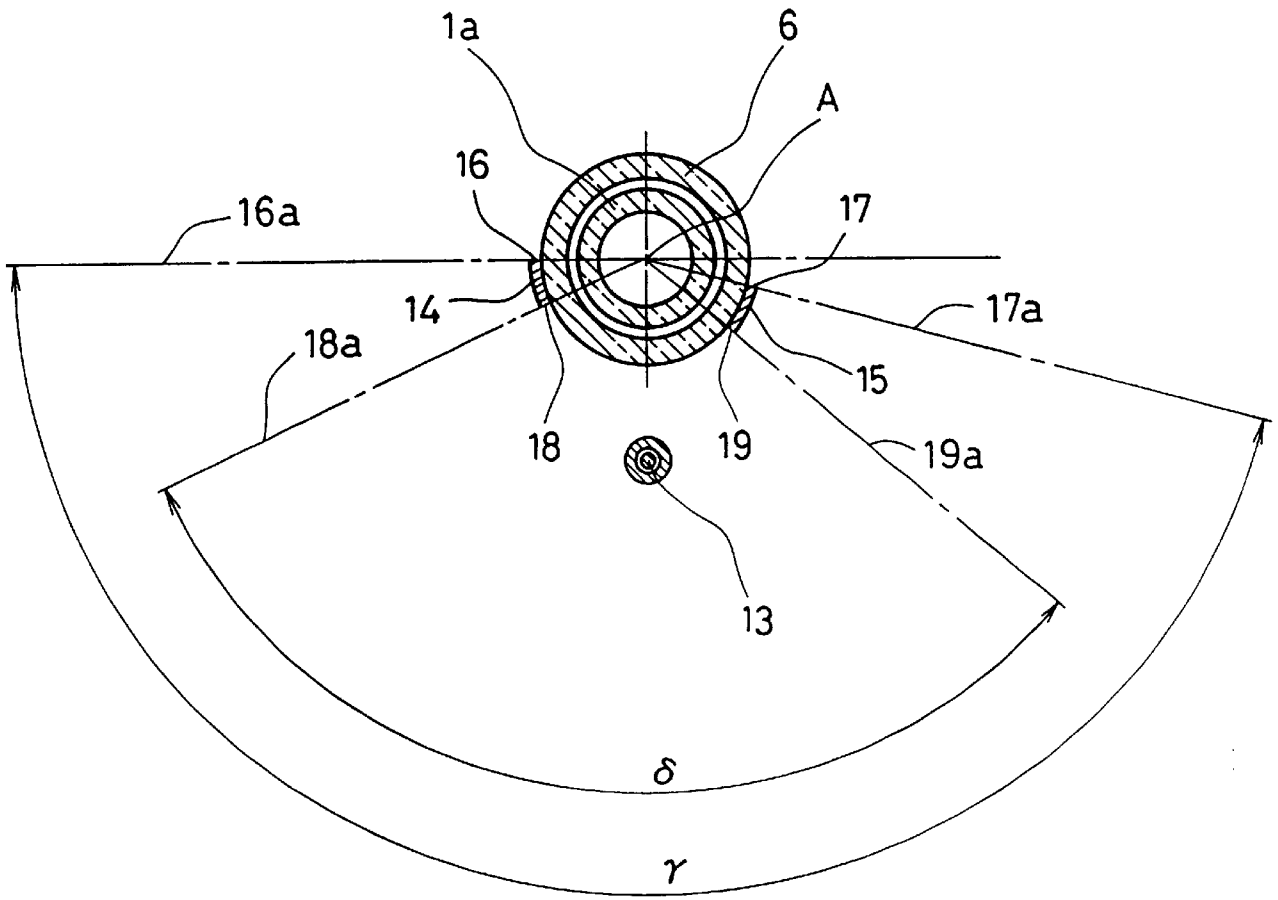
FIG. 3 is a sectional view taken along the line I—I of FIG. 1.

FIG. 3 is a sectional view taken along the line I—I of FIG. 1 passing through the point A. The point A is, specifically, the center point of the line connecting the tips of the electrodes 2*a* and 2*b* facing with each other within the discharge space 1*d*. In FIG. 3, an angle $\gamma$ is the angle, taken with respect to the side of lower edges 18 and 19 of respective light-intercepting films (i.e. on the side of the power supply line 13), between a line 16*a* passing through the point A and contacting an upper edge 16 of the light-intercepting film 14, and a line 17*a* passing through the point A and contacting an upper edge 17 of the light-intercepting film 15.

An angle $\delta$ is the angle, taken with respect to the side of lower edges 18 and 19 of respective light-intercepting films (i.e. on the side of the power supply line 13), between a line 18*a* passing through the point A and contacting the lower edge 18 of the light-intercepting film 14, and a line 19*a* passing through the point A and contacting the lower edge 19 of the light-intercepting film 15. In this embodiment, the angle $\gamma$ is 165 degrees, and the angle $\delta$ is 125 degrees.

Figure 4:
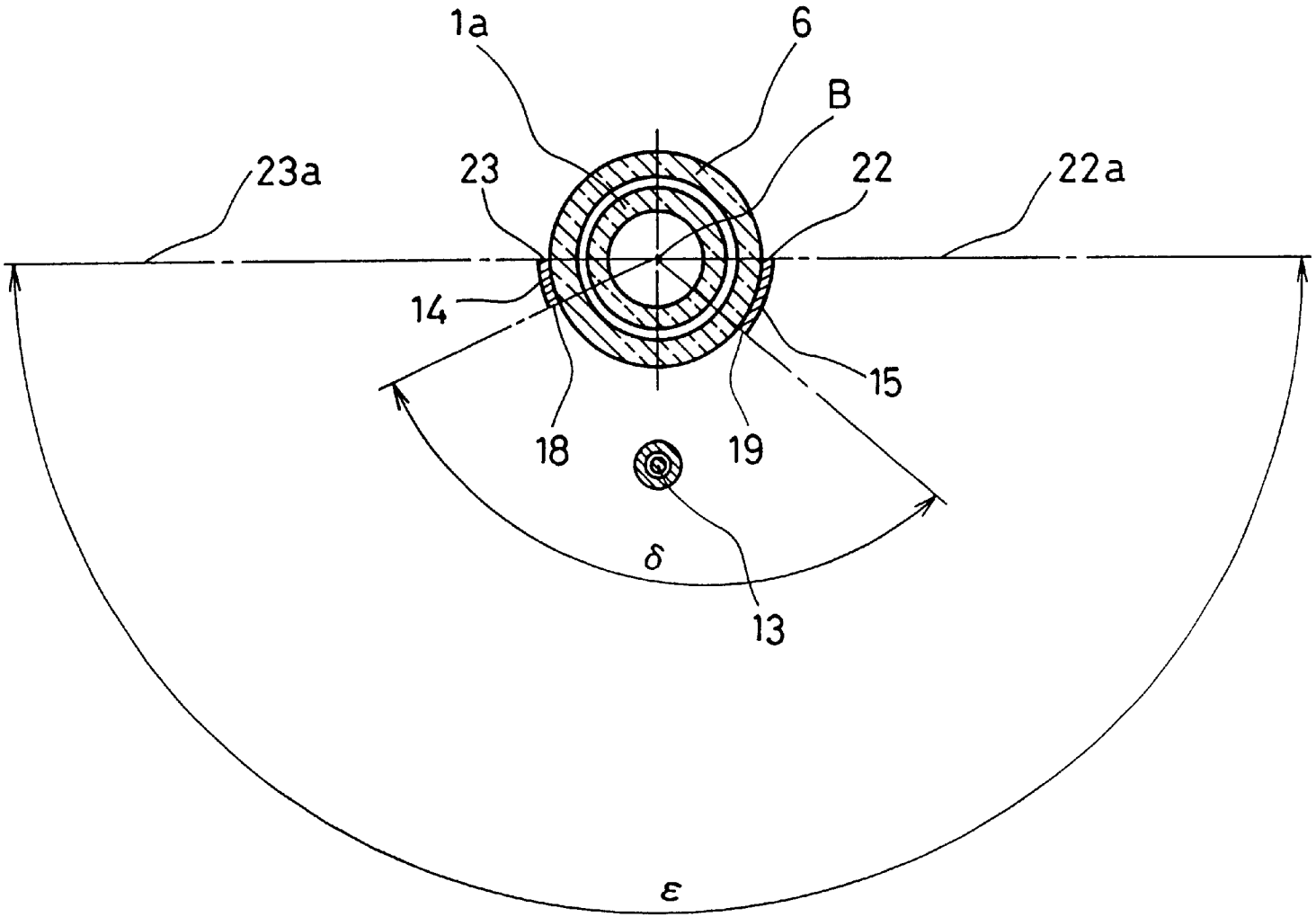
FIG. 4 is a sectional view taken along the line II—II of FIG. 1.

FIG. 4 is a sectional view taken along the line II—II of FIG. 1. That is, FIG. 4 is a cross section at a position in the region in which the extending portion 15*a* is formed, and a point B is the point on the axis 21 of the arc tube in this cross section. At this position, an angle $\epsilon$ shows the maximum value, which is 180 degrees in this embodiment. The angle $\epsilon$ is, specifically, the angle, taken with respect to the side of the lower edges 18 and 19 of respective light-intercepting films (i.e. on the side of the power supply line 13), between a line 23*a* passing through the point B and contacting an upper edge 23 of the light-intercepting film 14, and a line 22*a* passing through the point B and contacting an upper edge 22 of the light-intercepting film 15.

Comparing FIGS. 3 and 4, the angle $\delta$ is common, and the angle $\epsilon$ (180 degrees) is greater by 15 degrees than the angle $\gamma$ (165 degrees). That is, at the position shown in FIG. 4, at least one of the light-intercepting films 14 and 15 extends in the circumferential direction of the outer tube 6 toward the side opposite to the power supply line 13. This extending portion corresponds to the portion indicated by 15*a* in FIG. 1. When the positions of the line 16*a* of FIG. 3 and the line 23*a* of FIG. 4 in the circumferential direction of the outer tube 6 are the same, the extending portion is formed only in the light-intercepting film 15.

Furthermore, in this embodiment, as illustrated in FIG. 1, a light-intercepting film 20 is foamed on the external surface of the outer tube 6 within a region not facing the power supply line 13 and corresponding to the sealing portion 1*b* on the side of the base 7. As shown in FIG. 1, the light-intercepting film 20 extends on the external surface of the outer tube 6 on the side not facing the power supply line 13 from the position making an angle a of 45 degrees with a line 31 perpendicular to the axis 21 of the arc tube to the position making an angle $\beta$ of at least 70 degrees with the line 31 when using the point A as the apex.

Figure 10:
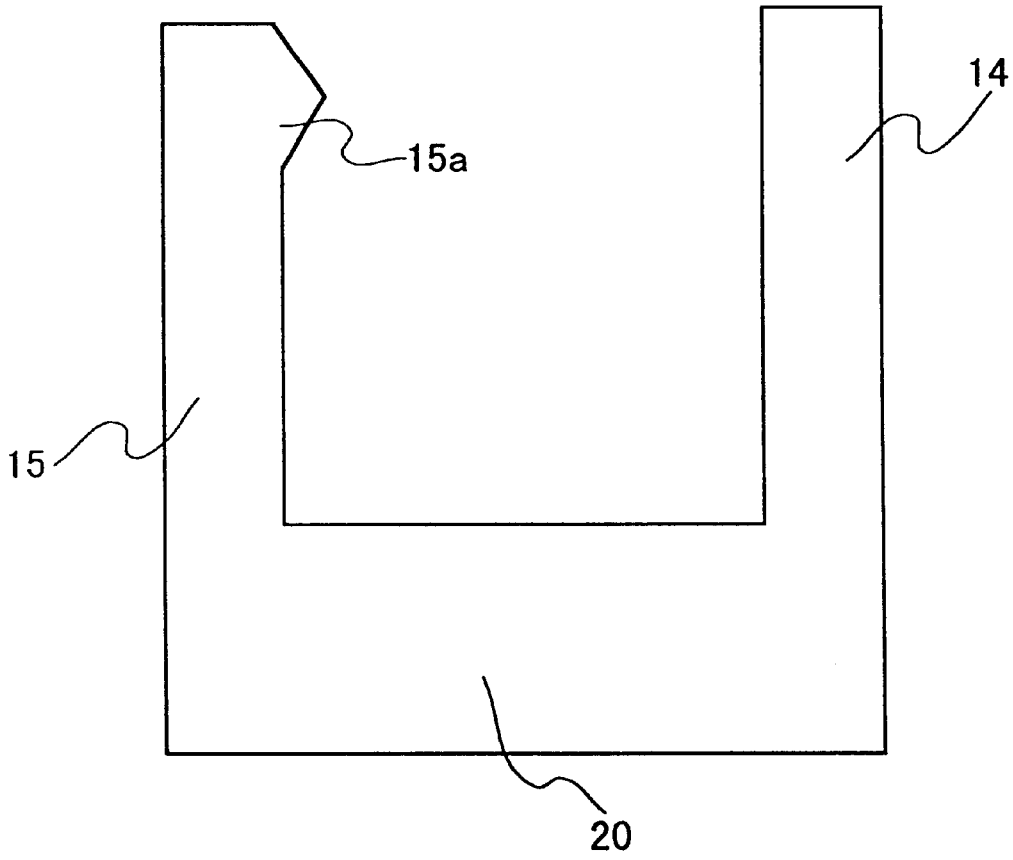
FIG. 10 shows a development of light-intercepting films in a discharge lamp according to one embodiment of the present invention.

To explain more specifically the pattern of the light-intercepting films, FIG. 10 illustrates a development of the light-intercepting films shown in FIG. 1. According to this drawing, it is understood that the extending portion 15*a* is formed in the light-intercepting film 15, one of the two band-shaped light-intercepting films 14 and 15.

Figure 9:
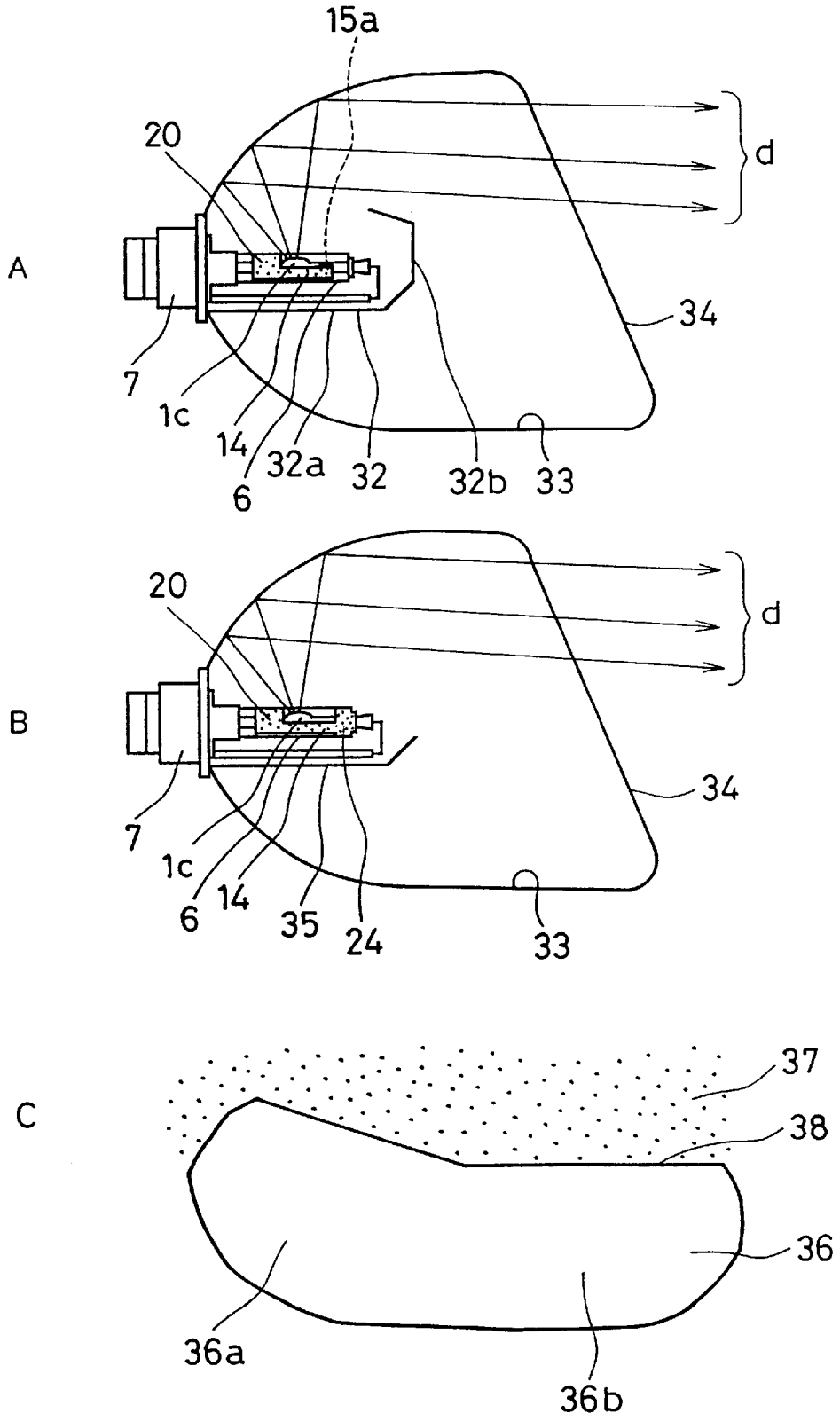
FIG. 9A shows a configuration of a headlight using a discharge lamp according to one embodiment of the present invention.
FIG. 9B shows a configuration of a headlight using a discharge lamp according to another embodiment of the present invention.
FIG. 9C shows one example of a light distribution pattern when using a discharge lamp according an embodiment of the present invention.

FIG. 9A shows a configuration of a headlight using the discharge lamp of this embodiment. The discharge lamp is arranged within a mirror 33 having a front glass 34 mounted at its opening. As shown by arrows "d", light radiated from the arc tube 1*c* is reflected by the mirror 33, and passes through the front glass 34 to illuminate forward. FIG. 9C shows a light distribution pattern. A region 36 is the region illuminated by the light passing through the front glass 34. A region 37 indicated by a dot pattern shows the region where light passing through the front glass 34 does not reach. The boundary between the regions 36 and 37 is a cutline 38.

To form such a light distribution, unwanted light from the arc tube 1*c* is cut by the light-intercepting film 20 and the light-intercepting films 14 and 15. Furthermore, lights radiated downward and forward with respect to the arc tube 1*c* are cut by sections 32*a* and 32*b* of a light-intercepting plate 32, respectively. In this embodiment, particularly, by having the light-intercepting film 15*a* extending in the circumferential direction of the outer tube 6, unwanted light can be cut more reliably.

Figure 11:
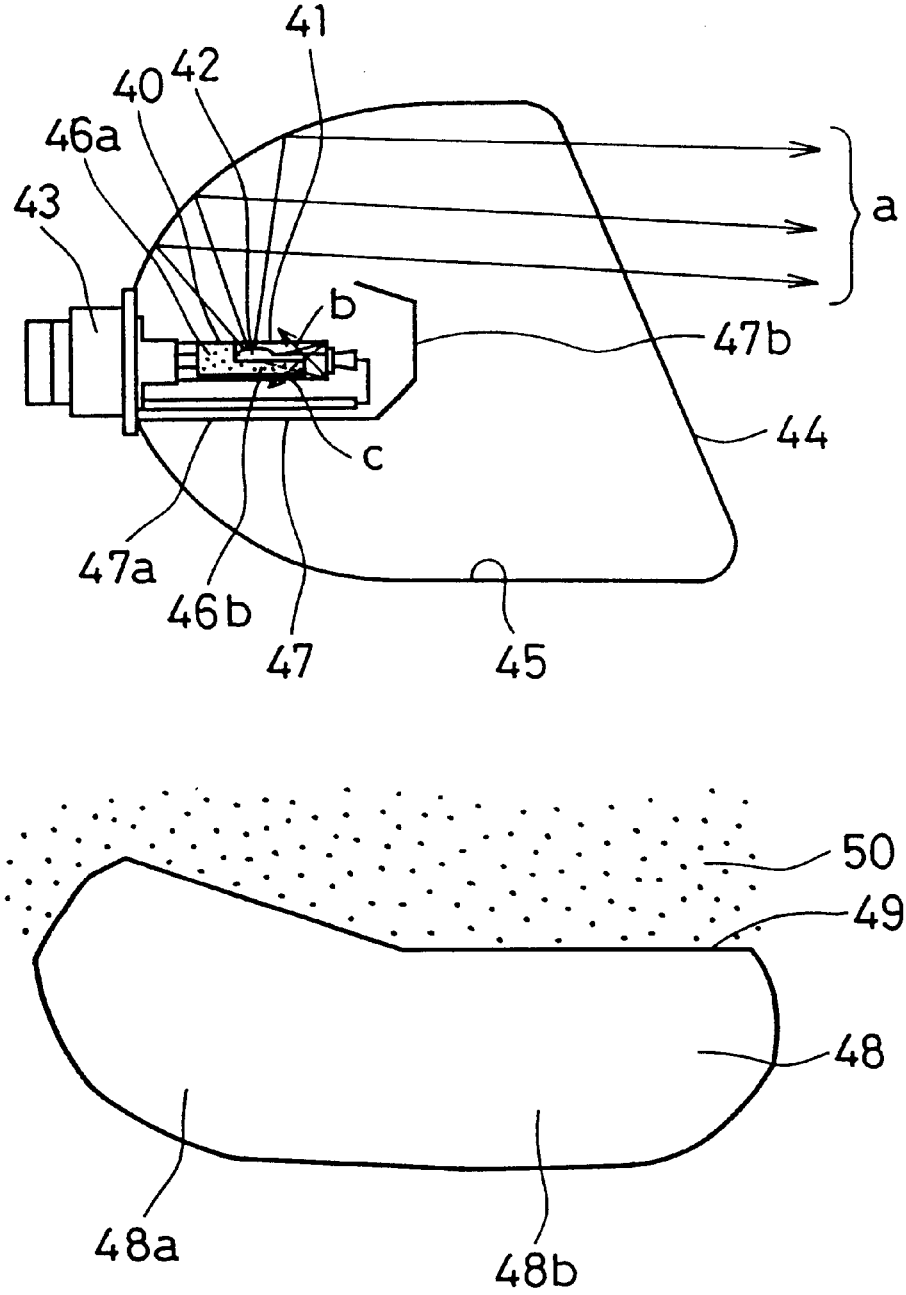
FIG. 11 PRIOR ART
FIG. 11A shows a configuration of one example of a headlight using a conventional discharge lamp.
FIG. 11B shows one example of a light distribution pattern when using a conventional discharge lamp.

In this embodiment, observing the light distribution pattern in the up-and-down direction as in the conventional example described with FIG. 11, an illuminated region indicated by 36*a* in FIG. 9C is wider than an illuminated region indicated by 36*b*. When a discharge lamp forming such a light distribution pattern is used for a vehicle, both sides of the driving lane and the opposing lane can be illuminated. For example, in the case of left-hand traffic, because the region 36*b* on the side of the opposing lane is cut for its upper illuminated region compared to the region 36*a* on the side of the driving lane, blinding of oncoming vehicles can be prevented.

In this embodiment, particularly, by having the light-intercepting film 15*a* extending in the circumferential direction of the outer tube 6, unwanted light can be cut more reliably. Thus, unevenness in the intensity distribution of the light distribution pattern can be reduced, and generation of glare can be prevented. That is, if the light-intercepting film 15*a* is not formed, reflected light from the end of the outer tube 6 on the side far from the base 7, particularly from the corners of the end (see 6*a* and 6*b* in FIG. 1), will pass through a portion of the outer tube 6 in which no light-intercepting film is formed, and illuminate forward through the mirror 45 and the front glass 44. The light-intercepting film 15*a* is particularly effective to cut such unwanted reflected light from the end of the outer tube 6 on the side far from the base 7.

Thus, according to this embodiment, unwanted light can be cut more reliably, and within the light distribution pattern as shown in FIG. 9C, the region 37 that does not need to be illuminated can be prevented from being illuminated, and the region 36 that has been illuminated by necessary light can be prevented from being illuminated over again. Accordingly, unevenness in the luminous intensity can be reduced, and generation of glare can be prevented.

Thus, glare can be reduced by the lamp itself, and there is no need to intercept unwanted light that cannot be cut sufficiently only by the light-intercepting films 20, 14 and 15 and the light-intercepting plate 32 by providing a further light-intercepting plate separately. That is, it is not necessary to add a further mechanism for reducing glare such as a light-intercepting plate. Thus, a lighting fixture can be simplified and reduced in weight.

Although an example in which the angle $\gamma$ is 165 degrees and the angle $\delta$ is 125 degrees has been described in this embodiment, the present invention is not limited to these angles.

Furthermore, a lens for refracting outgoing light may be mounted at the opening of the mirror 37 in place of the front glass 34.

Furthermore, the extending portion in the circumferential direction described with reference to FIGS. 3 and 4 may be provided at least in one of the two parallel light-intercepting films 14 and 15. And when the positions of the outer tube 6 of the line 16*a* of FIG. 3 and the line 23*a* of FIG. 4 in the circumferential direction are the same, the extending portion is formed only in the light-intercepting film 15.

As mentioned above, the role of the extending portion is to cut reflected light from the end of the outer tube 6 far from the base 7, and whether to form the extending portion in one of the light-intercepting films or in both of the light-intercepting films may be determined depending on the shape of the arc tube 1, the shape of the outer tube 6, the shape of the lighting fixture, etc. This is also the same for the angle $\epsilon$. That is, although the above embodiment has been described using an example in which the maximum value of the angle $\epsilon$ is 180 degrees, the angle e is not limited to this angle, and it is preferably in the range of $\epsilon>(\gamma+10)$ degrees, more preferably in the range of $\epsilon>(\gamma+20)$ degrees, and further more preferably in the range of $\epsilon>(\gamma+30)$ degrees. For example, when the angle $\epsilon$ is 360 degrees, that is, when the upper edges 22 and 23 of the band-shaped light-intercepting films shown in FIG. 4 contact each other, the effect of the present invention can be obtained sufficiently.

Furthermore, as mentioned above, because the extending portion has the role of cutting unwanted light in a portion of the outer tube 6 far from of the base 7, it is necessary to provide the extending portion at least on the side of the top 27 of the outer tube 6 with respect to the tip of the electrode 2*a* within the discharge space 1*d*. It is preferable that the extending portion is provided on the side of the top 27 of the outer tube 6 with respect to the discharge space 1*d*.

Furthermore, although an example in which the angle αis 45 degrees and the angle β is at least 70 degrees has been described as the range of forming the light-intercepting film 20, the present invention is not limited to these angles. Furthermore, a configuration in which the light-intercepting film 20 is not formed also may be employed.

Second Embodiment

Figure 6:
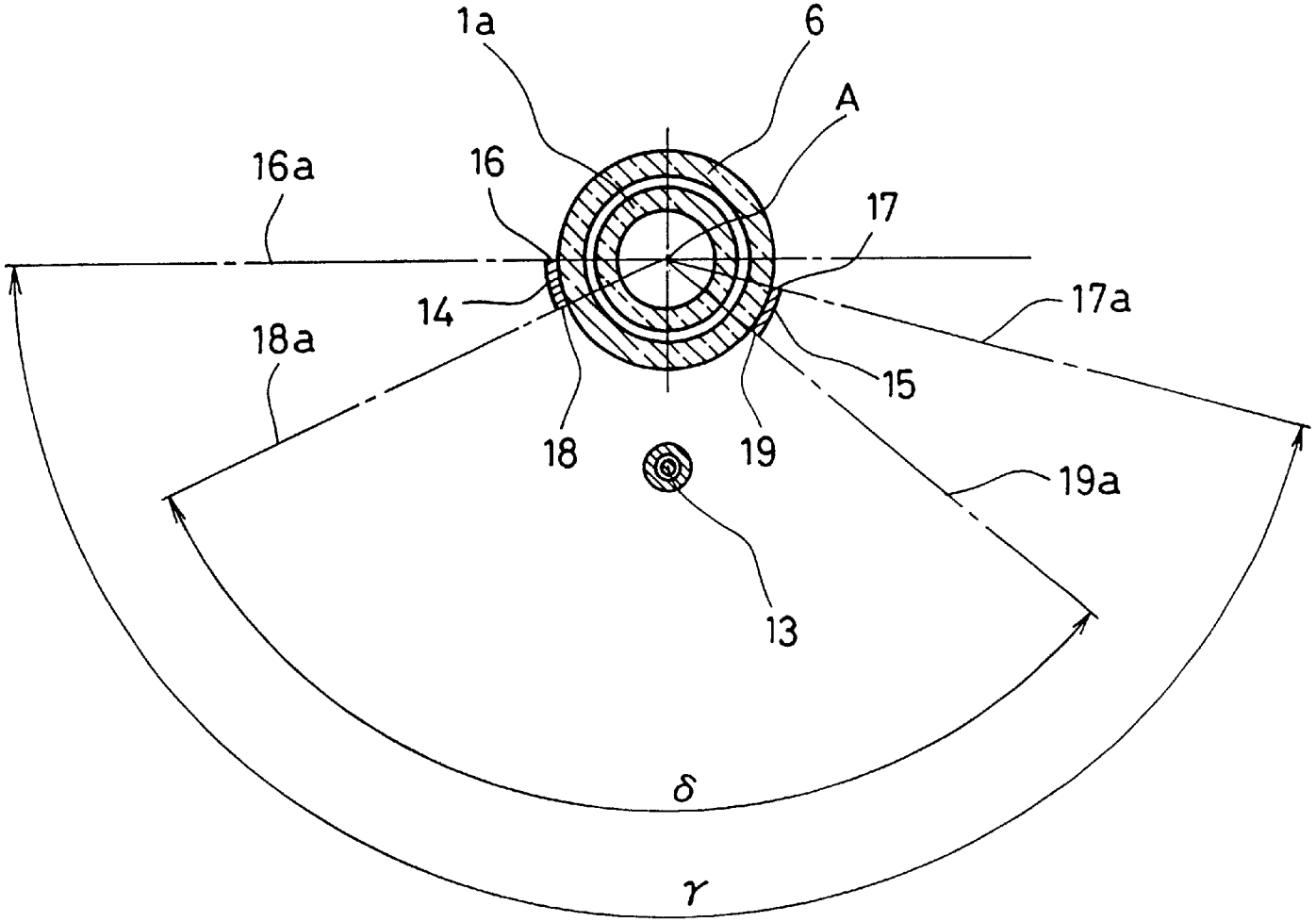
FIG. 6 is a sectional view taken along the line III—III of FIG. 5.

FIG. 5 is a side view of a discharge lamp according to the second embodiment of the present invention. The discharge lamp shown in this drawing is an embodiment of a metal halide lamp for a vehicle headlight. FIG. 6 is a sectional view taken along the line III—III of FIG. 5 passing through a center point A between electrodes 2*a* and 2*b*. The discharge lamp according to this embodiment has the same configuration as that of the first embodiment, except for the range of forming light-intercepting films.

As illustrated in FIGS. 5 and 6, two band-shaped light-intercepting films 14 and 15 are formed on the external surface of the outer tube 6 in parallel with the axis 21 of the arc tube and apart from each other within a region in the vicinity of the electrodes 2.

An angle γ shown in FIG. 6 is the angle, taken with respect to the side of lower edges 18 and 19 of respective light-intercepting films (i.e. on the side of the power supply line 13), between a line 16*a* passing through the point A and contacting an upper edge 16 of the light-intercepting film 14, and a line 17*a* passing through the point A and contacting an upper edge 17 of the light-intercepting film 15. An angle δ is the angle, taken with respect to the side of the lower edges 18 and 19 of respective light-intercepting films (i.e. on the side of the power supply line 13), between a line 18*a* passing through the point A and contacting the lower edge 18 of the light-intercepting film 14, and a line 19*a* passing through the point A and contacting the lower edge 19 of the light-intercepting film 15. In this embodiment, the angle γ is 165 degrees, and the angle δ is 125 degrees.

In this embodiment, as shown in FIG. 5, a light-intercepting film 20 also is formed on the external surface of the outer tube 6 within a region not facing the power supply line 13 and corresponding to the sealing portion 1*b* on the side of the base 7. As shown in FIG. 5, the light-intercepting film 20 extends on the external surface of the outer tube 6 on the side not facing the power supply line 13 from the position making an angle α of 45 degrees with a line 31 perpendicular to the axis 21 of the arc tube to the position making an angle β of at least 70 degrees with the line 31 when using the point A as the apex.

In this embodiment, as shown in FIG. 5, a light-intercepting film 24 having an edge 25 is formed on the side of the top 27 of the outer tube 6 with respect to the tip of the electrode 2*a* within the discharge space 1*d*. The light-intercepting film 24 covers the entire circumference of the side face of the outer tube 6 between the edge 25 and the top 27, and further covers the top 27. The top 27 of the outer tube 6 refers to the face of the outer tube 6 located at the top of the outer tube 6 in the axial direction.

As shown in FIG. 5, an angle ζ is the angle made by the line 31 passing through the point A and perpendicular to the axis 21 of the arc tube, and a line connecting the point A and the edge 25 of the light-intercepting film 24. The light-intercepting film 24 extends from the edge 25 to the edge on the top 27 in the direction away from the base 7. The angle ζ is, for example, 65 degrees, and preferably the angle ζ is at least 40 degrees.

FIG. 9B shows a configuration of a headlight using the discharge lamp of this embodiment. A mirror 33 having a front glass 34 is attached to the base 7. As shown by arrows "d", light radiated from the arc tube 1*c* is reflected by the mirror 33, and passes through the front glass 34 to illuminate forward. As in the first embodiment, the light distribution pattern will be such a pattern as shown in FIG. 9C.

In this embodiment, the light-intercepting film 24 plays the same role as the extending portion of the first embodiment. With the light-intercepting film 24, reflected light from the end of the outer tube 6 on the side far from the base 7 can be cut, and unwanted light can be cut more reliably. Thus, unevenness in the intensity distribution of the light distribution pattern can be reduced, and generation of glare can be prevented.

In this embodiment, because light is intercepted in a wider range than by the extending portion of the first embodiment, it is effective when the cutting of the reflected light from the end of the outer tube 6 on the side far from the base 7 only by the extending portion as in the first embodiment is not sufficient.

Thus, as in the first embodiment, because glare can be reduced by the lamp itself, it is not necessary to intercept unwanted light by providing a light-intercepting plate separately, and it is not necessary to add a further mechanism for reducing glare such as a light-intercepting plate. Thus, a lighting fixture can be simplified and reduced in weight.

Furthermore, because light is intercepted in a wider range than by the extending portion of the first embodiment, and particularly because the top 27 is covered, not only reflected light from the end of the outer tube 6, but also light trying to pass through the outer tube 6 to go forward can be cut.

In this way, when light trying to pass through can be cut, a light-intercepting plate 32*b* arranged in front of the discharge lamp as shown in FIG. 9A is unnecessary. FIG. 9B illustrates an example in which such a light-intercepting plate is not provided in front of the discharge lamp.

Although not illustrated, a light-intercepting film may cover the surface of a portion of the arc tube that is located on the side opposite to the base and protruding from the outer tube.

Although an example in which the angle γ is 165 degrees and the angle δ is 125 degrees has been described in this embodiment, the present invention is not limited to these angles.

Furthermore, although an example in which the angle α is 45 degrees and the angle β is at least 70 degrees has been described as the range of forming the light-intercepting film 20, the present invention is not limited to these angles. Furthermore, a configuration in which the light-intercepting film 20 is not formed also may be employed.

Third Embodiment

Figure 8:
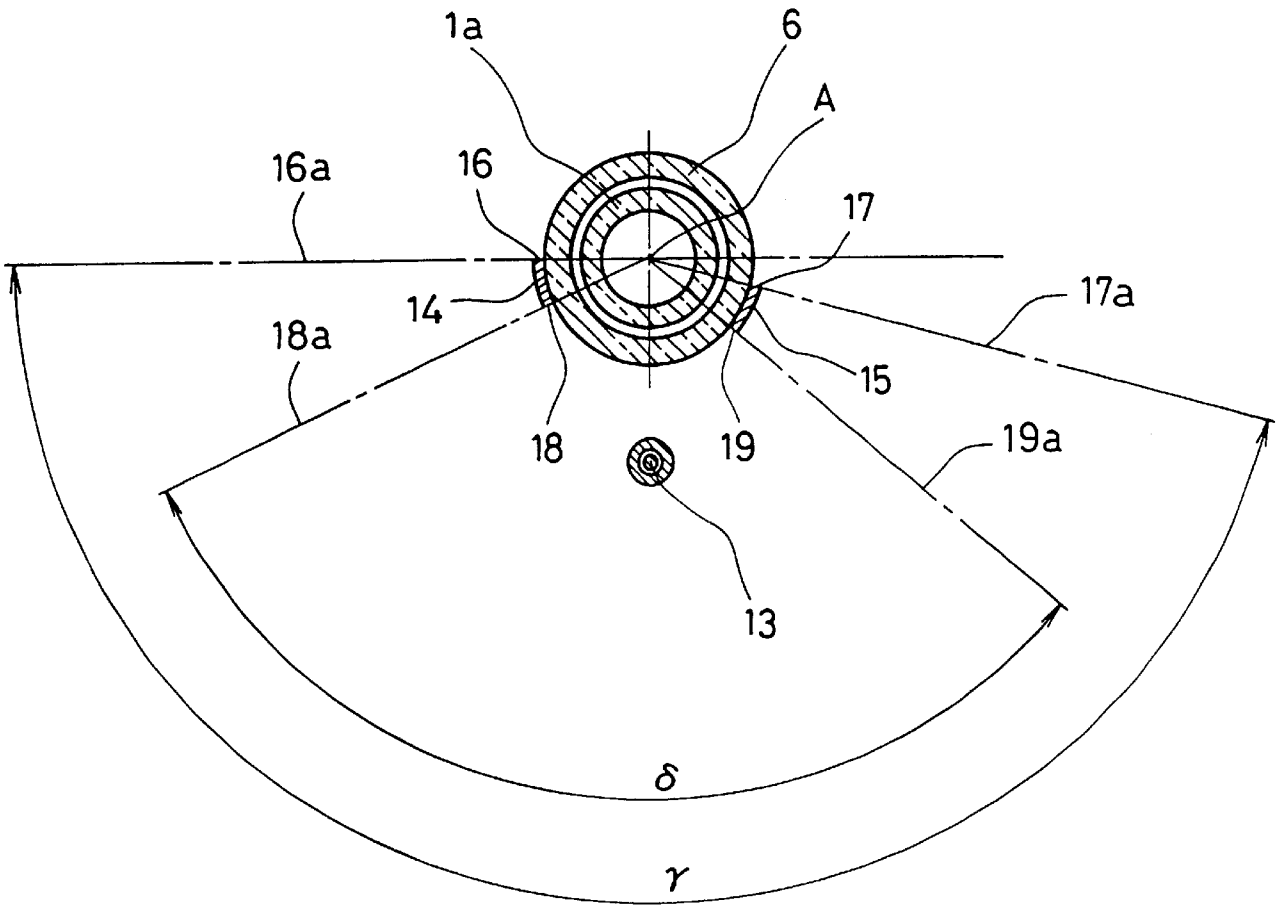
FIG. 8 is a sectional view taken along the line IV—IV of FIG. 7.

FIG. 7 is a side view of a discharge lamp according to the third embodiment of the present invention. The discharge lamp shown in this drawing is an embodiment of a metal halide lamp for a vehicle headlight. FIG. 8 is a sectional view taken along the line IV—IV of FIG. 7 passing through a center point A between electrodes 2*a* and 2*b*. The discharge lamp according to this embodiment has the same configuration as those of the first and second embodiments, except for the range of forming light-intercepting films.

As illustrated in FIGS. 5 and 6, two band-shaped light-intercepting films 14 and 15 are formed on the external surface of the outer tube 6 in parallel with the axis 21 of the arc tube and apart from each other within a region in the vicinity of the electrodes 2. An angle γ shown in FIG. 8 is the angle, taken with respect to the side of lower edges 18 and 19 of respective light-intercepting films (i.e. on the side of the power supply line 13), between a line 16a passing through the point A and contacting an upper edge 16 of the light-intercepting film 14, and a line 17*a* passing through the point A and contacting the upper edge 17 of the light-intercepting film 15. An angle δ is the angle, taken with respect to the side of lower edges 18 and 19 of respective light-intercepting films (i.e. on the side of the power supply line 13), between a line 18*a* passing through the point A and contacting the lower edge 18 of the light-intercepting film 14, and a line 19*a* passing through the point A and contacting the lower edge 19 of the light-intercepting film 15. In this embodiment, the angle γ is 165 degrees, and the angle δ is 125 degrees.

In this embodiment, as shown in FIG. 7, a light-intercepting film 20 is formed on the external surface of the outer tube 6 within a region not facing the power supply line 13 and corresponding to the sealing portion 1*b*on the side of the base 7. As shown in FIG. 7, the ligh extends on the external surface of the outer tube 6 on the side not facing the power supply line 13 from the position making an angle α of 45 degrees with a line 31 perpendicular to the axis 21 of the arc tube to the position making an angle β of at least 70 degrees with the line 31 when using the point A as the apex.

In this embodiment, as shown in FIG. 7, a light-intercepting film 28 is further formed. Both edges 29 and 30 of the light-intercepting film 28 are formed on the side of the top 27 of the outer tube 6 with respect to the tip of the electrode 2*a* within the discharge space 1*d*.

In the light-intercepting film 28, as shown in FIG. 7, an angle η is the angle made by the line 31 passing through the point A and perpendicular to the axis 21 of the arc tube, and the line connecting the point A and the edge 29 of the light-intercepting film 28. An angle θ is the angle made by the line 31 and a line connecting the point A and the edge 30 of the light-intercepting film 28. The angle η is, for example, 65 degrees, and the angle θ is, for example, 70 degrees. It is preferable that the angle η is at least 40 degrees, and the angle θ is at least 70 degrees.

The light-intercepting film 28 is formed in a ring form, that is, so as to cover the entire circumference, within the range limited by these angles.

In this embodiment, the light-intercepting film 28 plays the same role as the extending portion of the first embodiment. With the light-intercepting film 28, reflected light from the end of the outer tube 6 on the side far from the base 7 can be cut, and unwanted light can be cut more reliably. Thus, unevenness in the intensity distribution of the light distribution pattern can be reduced, and generation of glare can be prevented.

In this embodiment, because light is intercepted in a wider range than by the extending portion of the first embodiment, it is effective when the cutting of reflected light from the end of the outer tube 6 on the side far from the base 7 only by the extending portion as in the first embodiment is not sufficient.

Thus, as in the first embodiment, because glare can be reduced by the lamp itself, it is not necessary to intercept unwanted light by providing a light-intercepting plate separately, and it is not necessary to add a further mechanism for reducing glare such as a light-intercepting plate. Thus, a lighting fixture can be simplified and reduced in weight.

Although an example in which the angle γ is 165 degrees and the angle δ is 125 degrees has been described in this embodiment, the present invention is not limited to these angles.

Furthermore, although an example in which the angle α is 45 degrees and the angle β is at least 70 degrees has been described as the range of forming the light-intercepting film 20, the present invention is not limited to these angles. Furthermore, a configuration in which the light-intercepting film 20 is not formed also may be employed.

Furthermore, in the second and third embodiments, although light-intercepting films surrounding the circumference of the outer tube are formed on the side of the top of the outer tube, it is not always necessary that these light-intercepting films are completely continuous in the circumferential direction. For example, as in the embodiment illustrated in FIG. 9B, when a light-intercepting plate 35 is placed below the discharge lamp (on the side of power supply line), there may be a portion in which no light-intercepting film is formed on a lower side of the light-intercepting film 24 surrounding the outer tube.

Furthermore, although examples in which two band-shaped light-intercepting films are formed on the external surface of the outer tube have been described in the above respective embodiments, they may be formed on the internal surface of the outer tube.

As mentioned above, according to the present invention, reflected light from the end of the outer tube on the side far from the base can be cut, and unwanted light can be cut more reliably. Thus, unevenness in the intensity distribution of the light distribution pattern can be reduced, and generation of glare can be prevented. Furthermore, because glare can be reduced by the lamp itself, it is not necessary to intercept unwanted light by providing a light-intercepting plate separately, and it is not necessary to add a further mechanism for reducing glare such as a light-intercepting plate. Thus, a lighting fixture can be simplified and reduced in weight.

Finally, it is understood that the invention may be embodied in other specific forms without departing from the spirit or essential characteristics thereof. The embodiments disclosed in this application are to be considered in all respects as illustrative and not restrictive, so that the scope of the invention being indicated by the appended claims rather than by the foregoing description, and all changes which come within the meaning and range of equivalency of the claims are intended to be embraced therein.

What is claimed is:

1. A discharge lamp comprising: an arc tube having a discharge space in which a pair of electrodes having tips facing with each other are arranged; an outer tube enclosing the arc tube; a base that fixes one side of the outer tube; and two band-shaped light-intercepting films extending on a surface of the outer tube in a direction of an axis of the arc tube and in parallel with each other, the two band-shaped light-intercepting films having at least a portion overlapping both ends of the discharge space when viewing the outer tube in a direction perpendicular to an axis of the arc tube, wherein:

when the tip of the electrode that is furthest from the base is determined as a basis position, in at least one of the two band-shaped light-intercepting films, an extending portion is formed at a location further from the base than the basis position and extends in a circumferential direction of the outer tube.

2. The discharge lamp according to claim 1, wherein a power supply line is further arranged so as to face a side face of the outer tube, and the extending portion is formed so as to extend toward a side opposite to a side on which the power supply line and the outer tube face each other.

3. The discharge lamp according to claim 1, wherein when under a condition in which the outer tube is cut in a plane including a center point between the tips of the pair of the electrodes in a direction perpendicular to the axis of the arc tube, the angle, taken with respect to the side opposite the extending portion, between two lines connecting the center point and respective edges of the two light-intercepting films in a direction of an axis of the arc tube on the side of the extending portion is determined as an angle $\gamma$, and under a condition in which the outer tube is cut in a direction perpendicular to an axis of the arc tube in a portion where the extending portion is formed, an angle, taken with respect to the side opposite the extending portion, between the two lines connecting a point on the axis of the arc tube and respective edges of the two light-intercepting films in a direction of the axis of the arc tube on the side of the extending portion is determined as an angle $\epsilon$, a value of the angle $\epsilon$ is at least $(\gamma+10)$ degrees.

4. The discharge lamp according to claim 1, wherein respective edges on one side of the two band-shaped light-intercepting films are connected through the extending portion.

5. The discharge lamp according to claim 1, wherein the light-intercepting films are formed by uniting a heat-resistant light-intercepting sheet material with a surface of the outer tube.

6. The discharge lamp according to claim 5, wherein the heat-resistant light-intercepting sheet material is a greensheet containing an inorganic material and an inorganic matrix component, and the greensheet is united with the surface of the outer tube by calcining the greensheet adhered on the surface of the outer tube.

7. A discharge lamp comprising: an arc tube having a discharge space in which a pair of electrodes having tips facing with each other are arranged; an outer tube enclosing the arc tube; a base that fixes one side of the outer tube; and first two band-shaped light-intercepting films extending on a surface of the outer tube in a direction of an axis of the arc tube and in parallel with each other, the first light-intercepting films having at least a portion overlapping both ends of the discharge space when viewing the outer tube in a direction perpendicular to an axis of the arc tube, wherein:

further comprising a second light-intercepting film covering the outer tube in a circumferential direction, wherein when the tip of the electrode that is furthest from the base is determined as a basis position, both edges of the second light-intercepting film in a direction of an axis of the arc tube are located at a position further from the base than the basis position.

8. The discharge lamp according to claim 7, wherein an angle made by a line passing through a center point between the tips of the pair of the electrodes and perpendicular to the axis of the arc tube, and a line connecting the center point and the edge of the second light-intercepting film closer to the center point is at least 40 degrees.

9. The discharge lamp according to claim 8, wherein an angle made by the line perpendicular to the axis of the arc tube, and the line connecting the center point and the edge of the second light-intercepting film farther from the center point is at least 70 degrees.

10. The discharge lamp according to claim 7, wherein the second light-intercepting film covers the outer tube in a ring form.

11. The discharge lamp according to claim 7, wherein the edge of the second light-intercepting film farther from a center point between the tips of the pair of the electrodes is located at a top of the outer tube, and the second light-intercepting film covers the outer tube in a circumferential direction and covers the top of the outer tube.

12. The discharge lamp according to claim 7, wherein the light-intercepting films are formed by uniting a heat-resistant light-intercepting sheet material with a surface of the outer tube.

13. The discharge lamp according to claim 12, wherein the heat-resistant light-intercepting sheet material is a greensheet containing an inorganic material and an inorganic matrix component, and the greensheet is united with the surface of the outer tube by calcining the greensheet adhered on the surface of the outer tube.

* * * * *